US011447210B2

(12) United States Patent
Walpurgis

(10) Patent No.: US 11,447,210 B2
(45) Date of Patent: Sep. 20, 2022

(54) WATER BOARD TOWABLE BY A MOTORIZED WATERCRAFT

(71) Applicant: CAYAGO TEC GmbH, Bad Salzuflen (DE)

(72) Inventor: Hans-Peter Walpurgis, Bad Salzuflen (DE)

(73) Assignee: CAYAGO TEC GmbH

( * ) Notice: Subject to any disclaimer, the term of this patent is extended or adjusted under 35 U.S.C. 154(b) by 20 days.

(21) Appl. No.: 16/970,347

(22) PCT Filed: Feb. 27, 2019

(86) PCT No.: PCT/EP2019/054875

§ 371 (c)(1),
(2) Date: Aug. 15, 2020

(87) PCT Pub. No.: WO2019/166496

PCT Pub. Date: Sep. 6, 2019

(65) Prior Publication Data

US 2021/0001960 A1 Jan. 7, 2021

(30) Foreign Application Priority Data

Feb. 27, 2018 (DE) ..... 10 2018 104 431.3

(51) Int. Cl.
*B63B 32/10* (2020.01)
*B63B 32/20* (2020.01)
(Continued)

(52) U.S. Cl.
CPC ..... *B63B 32/10* (2020.02); *B63B 21/56* (2013.01); *B63B 32/20* (2020.02); *B63B 32/51* (2020.02); *B63B 34/54* (2020.02)

(58) Field of Classification Search
CPC ..... B63B 32/10; B63B 32/20; B63B 32/22; B63B 32/51; B63B 34/52; B63B 34/54;
(Continued)

(56) References Cited

U.S. PATENT DOCUMENTS 2,045,645 A * 6/1936 Hansen ..... B63B 32/10 114/55.54
3,952,354 A * 4/1976 Turner ..... B62B 15/00 441/65
(Continued)

FOREIGN PATENT DOCUMENTS

DE 19511850 A1 10/1996
DE 10009278 A1 9/2001
(Continued)

OTHER PUBLICATIONS

International Search Report dated Apr. 23, 2019 in corresponding PCT Application PCT/EP2019/054875 (Not Prior Art).
(Continued)

*Primary Examiner* — Ajay Vasudeva
(74) *Attorney, Agent, or Firm* — Lucian Wayne Beavers; Patterson Intellectual Property Law, PC

(57) ABSTRACT

The invention relates to a water board (2) made of a material that can float on water, having a support area (8), on which a user rests at least partially. To reduce the current forces acting on the user while holding on to and being towed behind a motorized watercraft (24), it is proposed that the water board (2) has, at a front-end area, an attachment segment (22) for the articulation of the water board (2) to the watercraft (24).

16 Claims, 9 Drawing Sheets

(51) Int. Cl.
*B63B 32/51* (2020.01)
*B63B 34/54* (2020.01)
*B63B 21/56* (2006.01)

(58) Field of Classification Search
CPC ..... B63B 34/60; B63B 34/63; B63B 34/67; B63B 21/56; B63C 11/46
See application file for complete search history.

(56) References Cited

U.S. PATENT DOCUMENTS

| | | | | | |
|---|---|---|---|---|---|
| RE28,916 | E | * | 7/1976 | Rice | A61G 1/00 5/628 |
| 4,717,362 | A | * | 1/1988 | Kraft | B63C 9/02 441/82 |
| 5,354,222 | A | | 10/1994 | Elias | |
| 5,357,891 | A | * | 10/1994 | Kobayashi | B63B 34/54 114/242 |
| D394,095 | S | * | 5/1998 | Kuan | B62B 15/00 D21/809 |
| 5,878,687 | A | | 3/1999 | Grimmeisen | |
| 5,941,540 | A | * | 8/1999 | O'Haire | B62B 15/00 280/18 |
| 6,066,016 | A | * | 5/2000 | Yonover | B63C 9/04 235/379 |
| 6,217,401 | B1 | * | 4/2001 | Peterson | B63B 34/54 441/65 |
| 6,283,811 | B1 | | 9/2001 | Peterson | |
| 8,251,007 | B2 | | 8/2012 | Walpurgis | |
| 2007/0051775 | A1 | | 3/2007 | Lei | |
| 2015/0064995 | A1 | | 3/2015 | Woods et al. | |
| 2015/0232160 | A1 | | 8/2015 | Robinson | |

FOREIGN PATENT DOCUMENTS

| | | | | | |
|---|---|---|---|---|---|
| DE | 102007032392 | A1 | | 1/2009 | |
| EP | 2078670 | A1 | | 7/2009 | |
| FR | 2767777 | A1 | * | 3/1999 | B63B 21/56 |
| FR | 2771996 | A1 | * | 6/1999 | B63C 9/02 |
| FR | 2858293 | A1 | * | 2/2005 | B63C 9/02 |
| JP | 48-6794 | U | | 1/1973 | |
| JP | 02126869 | A | | 5/1990 | |
| JP | 05278678 | A | | 10/1993 | |
| JP | 2003024470 | A | | 1/2003 | |

OTHER PUBLICATIONS

German Office Action for the corresponding patent application No. 102018104431.3, dated Oct. 24, 2018,12 pages (not prior art).

* cited by examiner

WATER BOARD TOWABLE BY A MOTORIZED WATERCRAFT

The present invention relates to a water board made of a material that can float on water. The water board includes a support area, on which a user can lie at least partially.

Such water boards are known from the state of the art in various embodiments. In a first known embodiment, the water board is relatively small and serves as a swimming aid, especially for children and non-swimmers. The user rests his hands and/or part of his forearms on the support area of the water board and the legs perform swimming movements. In other well-known embodiments, the water board is designed, for instance, as a surfboard for windsurfing or surfing or as a stand-up-paddling (SUP) board.

Furthermore, from the state of the art, e.g. DE 195 11 850 A1 and DE 100 09 278 A1, a motor-powered watercraft, which has two grab handles in the front area of the motor-powered watercraft which a user can hold on to, is known. The watercraft is preferably propelled by a water jet propulsion system, in which a water current is generated through a flow channel on the underside of the watercraft, which runs counter to the direction of travel of the watercraft. In particular, water is sucked in through an inlet opening in the underside of the hull or in the area of the bow of the watercraft, accelerated by means of a marine propeller located in the flow channel and discharged via an outlet opening in the area of the stern of the watercraft. The marine propeller is preferably driven by an electric motor powered by batteries. The user's arms and possibly part of the user's abdomen lie on a support area of the motor-powered watercraft and the user steers it, for instance by shifting weight. The user can control the speed of the motor-powered watercraft by means of controls in the area of the handles, for instance by varying the speed of the propeller or an angle of attack of a flap located in the flow channel. The known motor-powered watercraft can be used for swimming on water but also for diving under water.

During the operation of the known motor-powered watercraft, wherein the user holds on to the watercraft and is dragged by the watercraft on or through the water, it has been shown that, due to the resistance to flow, forces act in particular on the user's lower body and legs, which threaten to pull the user aft away from the watercraft. The user has to hold on to the handles to counteract these forces. This can be very strenuous and tiring, especially when driving longer distances and/or at faster speeds.

This invention therefore addresses the problem of creating an option to reduce the forces acting on the user during the intended operation of the watercraft, such that the watercraft can be used with as little effort and fatigue as possible even when driving longer distances and/or at faster speeds.

This problem is solved by the water board having the features of claim 1 and an aquatic sports device having the features of claim 16. The subject matter of the dependent claims relates to advantageous embodiments and further developments of this invention.

In the context of this invention, it is thus proposed to reduce the flow resistance of the user by placing at least part of the user's body, which was previously in the water, on the support area of the water board, which is articulated to the watercraft. The watercraft and the water board in conjunction form the aquatic sports device according to the invention. Because of the articulated connection of the water board to the watercraft, the maneuverability and agility of the aquatic sports device is fully maintained. At the same time, a large part of the forces previously acting on the user during operation of the watercraft are transferred to the water board and transmitted to the watercraft via the articulated attachment segment of the water board. In addition, the overall flow resistance can be reduced by designing the underside of the water board that is in contact with the water to be streamlined. In this way, the aquatic sports device according to the invention can be used to achieve considerably higher speeds at the same power of the watercraft. The user of the aquatic sports device is exposed to considerably lower current forces, resulting in the use of the watercraft being effortless and fatigue-free, even when driving longer distances and/or at faster speeds.

Many different embodiments of the attachment segment are conceivable, which attachment segment is used to articulate the water board is to the watercraft. For instance, the water board could have a front support segment where the attachment segment is located and which is designed to rest on a top surface of the watercraft when the water board is secured to the watercraft. For this purpose, it may be provided that a suitable attachment mount is formed on the top face of the hull of the watercraft, which attachment mount is used to engage with the attachment segment of the water board. The front end of the board is positioned above the watercraft and only the rear end, and possibly also at least part of a central area of the water board, is in the water. The attachment mount can, for instance, be designed as a recess, into which an attachment segment designed as a projection or pin is inserted from above. In addition, a safety device may be provided to secure the attachment segment in the attachment mount and to prevent—at least during the intended use of the aquatic sports device—the inadvertent separation of the water board from the watercraft.

According to a preferred embodiment of the invention, it is proposed to design the attachment segment for a detachable attachment of the water board to the watercraft. This permits a simple and quick disconnection of the water board from the watercraft, i.e. the aquatic sports device can be transported in parts and the transport is made easier that way. The articulated connection of the water board to the watercraft is preferably implemented by means of a quick release fastener or a snap fastener, which can be closed and opened easily even in water, when fingers are cold, damp and/or clammy.

The support area of the water board is preferably designed such that at least the chest and possibly also the stomach of the user rest(s) on the water board. Based on such an embodiment of the water board, the part of the user's body that causes the greatest resistance to flow in the water is arranged on the water board. The support area can be designed such that the user's legs also rest on the water board. In this way, the entire body of the user rests either on the top of the watercraft or on the support area of the water board, thus minimizing flow resistance. Based on this embodiment, the aquatic sports device can achieve particularly high final speeds and curve speeds. Alternatively, it is conceivable that the support area at a rear-end area of the water board merges into two lateral thigh supports sloping towards the water, on which the upper or lower legs of the user rest and between which a clamping area is formed, which can be arranged between the user's legs and clamped in between. In this way, the users can use their thighs to hold on to the water board. In this embodiment, the user's feet and—depending on the specific embodiment of the water board—possibly also the lower legs are in the water and can assist in controlling the aquatic sports device. Thus, this embodiment makes for a particularly athletic, agile and maneuverable operation of the aquatic sports device.

Alternatively or in addition, it may be provided that the support area is limited laterally by support flanks, which make it more difficult for the user to slip downwards while using the water board. The support flanks preferably have a roughly cylindrical or cylinder-like shape having a longitudinal extension extending roughly in the direction of travel of the aquatic sports device. The support flanks protrude upwards above the main plane of the support area and support the user laterally during the operation of the sports equipment. The support flanks are preferably formed by inflatable chambers, which are formed separately from the rest of the water board. Inflatable chambers are elastically yielding, i.e. the user is held particularly gently and comfortably.

In accordance with an advantageous further development of the present invention, it is proposed that the attachment segment has an articulation comprising two axes of rotation parallel to each other, wherein a first axis of rotation is articulated to the water board and the other axis of rotation is assigned to the watercraft. Preferably, the axes of rotation extend mainly horizontally when the water board is secured to the watercraft. The articulation therefore permits the watercraft and the water board to be at different heights during operation of the aquatic sports device, or the height of the two can vary relative to each other. This makes for a particularly sporty and agile use of the aquatic sports device, in particular when there are waves on the water surface, which is very similar to using the watercraft without a water board secured thereto, i.e. with the user's body dragging in the water, except that the forces acting on the user are significantly lower.

It is also conceivable to design the attachment segment in the manner of a cardan joint. In this context, it is proposed in particular that the attachment segment is designed to articulate the water board to the watercraft using two perpendicular articulation axles. It is conceivable that one of the axes of rotation of the articulation forms a first articulated axle of the attachment segment and another axle, which is not one of the axles of rotation of the articulation and which, when the water board is secured to the watercraft, extends mainly vertically, forms the other axis of articulation of the attachment segment.

According to an advantageous further development of the invention, it is proposed that the front-end area of the water board is angled upwards by a few angular degrees, preferably 5°, with respect to the rest of the water board. When the motor-powered watercraft, which is articulated to the front end of the water board, accelerates, its bow will lift a little out of the water and its stern will sink a little into the water. All in all, this results in an inclination of the watercraft by a few angular degrees, in particular by about 3° to 10°. The angled front-end area of the water board is adapted to the inclination of the watercraft during operation, thus preventing the inclined watercraft from transferring large bending moments to the front-end area of the water board.

According to a favorable embodiment of the invention, it is proposed that the bottom of the water board, which rests on the water, has trailing edges, which protrude downwards beyond a surface area of the bottom and project into the water, each of which has an extension direction having a component transverse to a longitudinal extension of the water board. The trailing edges reduce a suction effect, which is caused by the water jet flowing beneath the water board and which can pull the water board downwards. This is accomplished by sucking in air from the side via the trailing edges and directing it beneath the water board into the area of the water jet. There the air causes a stall, reducing the suction effect. Several trailing edges can be arranged one behind the other in the longitudinal direction and spaced apart from each other. The last trailing edges are located about 5 cm away from the rear end of the water board. Two oblique trailing edges can be combined to form a V-shape, with one tip of the V pointing forward.

Particularly advantageously the water board is at least partially made of an inflatable material. Especially a core of the water board can be made of the inflatable material. The outer shape of the water board can then be formed by free-form flanks, which are secured to the core of inflatable material on the outside. The free-form flanks are preferably made of a plastic material and are secured to the core of inflatable material, for instance by gluing or clipping. The free-form flanks thus form at least part of the outer skin of the water board. Through a valve located in the outer skin of the water board, air can be pumped into the interior of the inflatable material or the air can be removed from the interior. The valve is preferably located on the top of the water board, especially at the rear-end area. It has been shown that an inflatable material particularly suitable for the water board is a so-called drop stitch fabric material. Drop stitch material can be used to build inflatable water boards that are particularly dimensionally stable when inflated. The principle of the drop stitch design is based on linking the inner sides of the top and bottom of the water board using vertical connecting fibers and keeping them in the desired shape even at high internal pressure. The result is a fabric that is very tear-resistant and dimensionally stable due to the large number of knots and can withstand particularly high loads, yet can still be folded compactly when not inflated. An internal pressure of approximately 100 kPa (1 bar) to 175 kPa (1.75 bar) can be achieved in the drop stitch material. Different layers of drop stitch fabric can be bonded and vulcanized to PVC of different qualities.

According to another advantageous further development of the invention, it is proposed that the water board has a flat underside resting on the water or, on its underside, two lateral skids extending along at least part of a longitudinal extension of the water board. On the one hand, this has the advantage that the flow resistance of the water board can be reduced, because only a small part of the bottom of the water board, namely the skids, is in contact with the water. Due to the reduced flow resistance, higher speeds of the watercraft or the entire aquatic sports device can be achieved. If the water board is attached to a hydrojet watercraft having a flow channel arranged centrally on the underside of the watercraft, the embodiment of the water board proposed in accordance with this further development also has the advantage that the water jet accelerated in the flow channel can flow freely at the stern of the watercraft and is guided along the underside of the water board between the skids. I.e., the accelerated water jet does not hit the water board secured to the watercraft after exiting the flow channel. In this way, a particularly efficient propulsion of the watercraft or the entire sports equipment can be achieved.

It is particularly preferred if the skids are formed on a rear-end area of the underside of the water board. The front-end of the water board then rests on the watercraft and the attachment segment is used to articulate it to the latter. Because the skids do not extend over the entire length of the water board, the flow resistance can be reduced further.

The skids on the underside of the water board can be designed in different ways. It has proved to be particularly advantageous if the water board has a U-shaped cross-section in the area of the skids, with distal ends of the two legs of the U-shaped cross-section protruding into the water and forming part of the skids. In accordance with this embodiment, the skids are therefore an integral with the water board. If the water board is at least partially made of an inflatable material, the skids may be part of a core of inflatable material or may be formed by free-form flanks attached to the core.

In order to facilitate the transport of the water board and its articulated attachment to the watercraft, it is proposed that at least one handle is placed laterally in the front-end area of the water board. Preferably one handle each is arranged in the front-end area on opposite sides. To improve the feel and the water resistance of the handle, it is preferably made of neoprene. The handles are preferably arranged on the sides of the water board in such a way that they are located outside the water, i.e. above the water surface, when the water board or aquatic sports device is used as intended.

The support area at the top of the water board shall preferably have a surface, which, by virtue of its shape and/or the nature of the material, prevents the user from slipping and/or water from accumulating during the use of the water board or aquatic sports device. It is particularly preferred if the support area has longitudinal ribs having a support surface that is convex in cross-section. The longitudinal ribs extend in parallel to each other in the longitudinal direction along at least part of the top face of the water board. A dragging handle and/or a tow eye may be arranged at the rear-end of the water board, which can be used to tow other water sports enthusiasts with or without swimming apparatus (e.g. another water board, an air mattress, a boat) behind the aquatic sports device according to the invention.

During the intended operation of the aquatic sports device according to the invention, a part of the user's body (e.g. the chest, abdomen and thighs) lie on the support area of the water board. The user can use another part of the user's body (e.g. the forearms) to support the user on the top of the watercraft and holds on to the watercraft's grab handles with his hands. The use of the water board considerably reduces the flow resistance of the user pulled behind the watercraft, without however limiting the mobility, dynamics and agility of the watercraft. On the contrary, by using the water board, much higher final and cornering speeds can be achieved. In addition, thanks to the water board, the use of the aquatic sports device is particularly effortless and fatigue-free for the user, even when traveling for long periods and at high speeds.

Further features and advantages of this invention are explained in more detail below on the basis of the Figures. The Figures show different exemplary embodiments the individual features of which can be combined in any way, even if this is not explicitly shown in the Figures and not explicitly mentioned in the description. In the Figures:

FIG. 1 shows a top view of a water board according to the invention according to various embodiments;

FIG. 1*a* shows an enlarged view of a segment of the water board attachment segment of FIG. 1;

Figure 6:
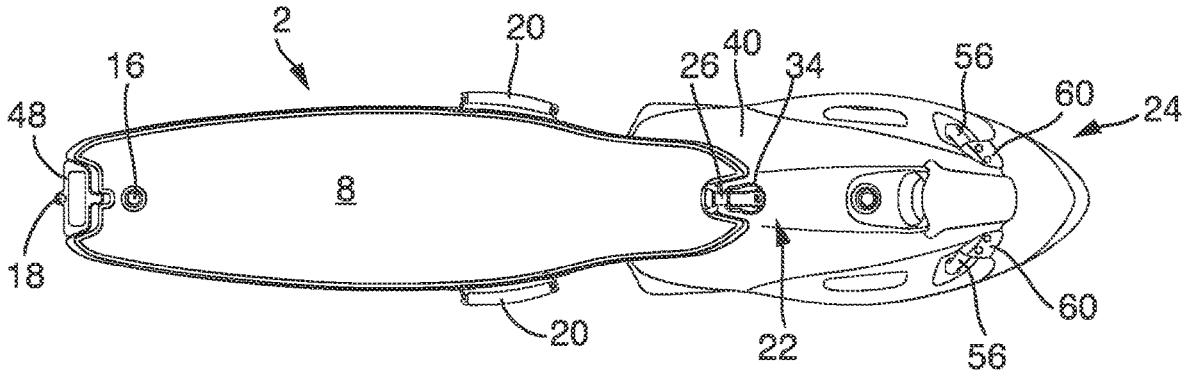
FIG. 6 shows a plan view of an aquatic sports device according to the invention according to a first preferred embodiment.
Figure 7:
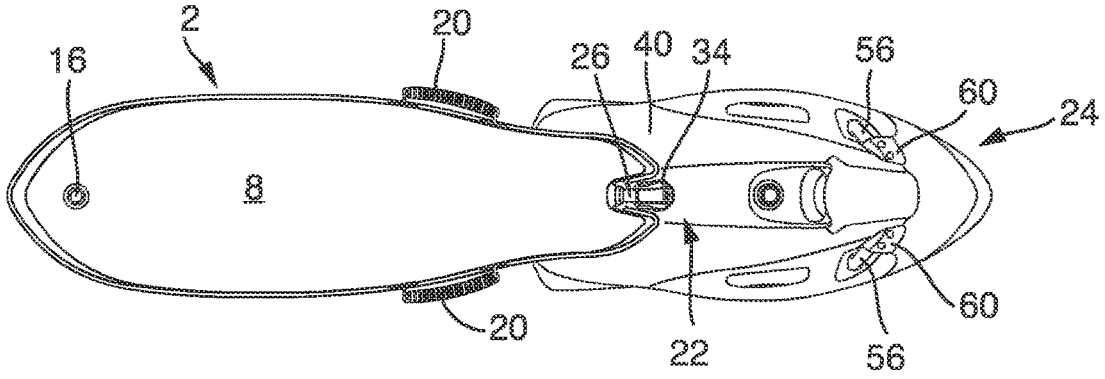
FIG. 7 shows a plan view of an aquatic sports device according to the invention according to a second preferred embodiment.
Figure 8:
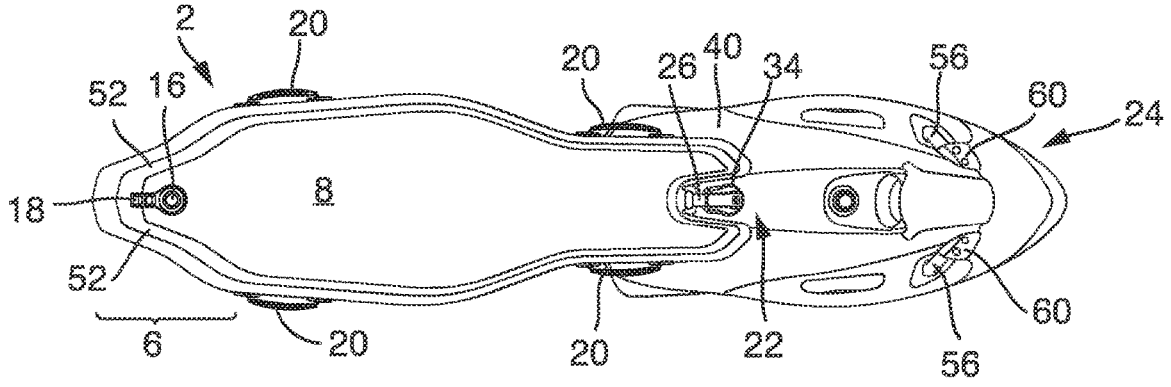
FIG. 8 shows a plan view of an aquatic sports device according to the invention according to a third preferred embodiment.
Figure 9:
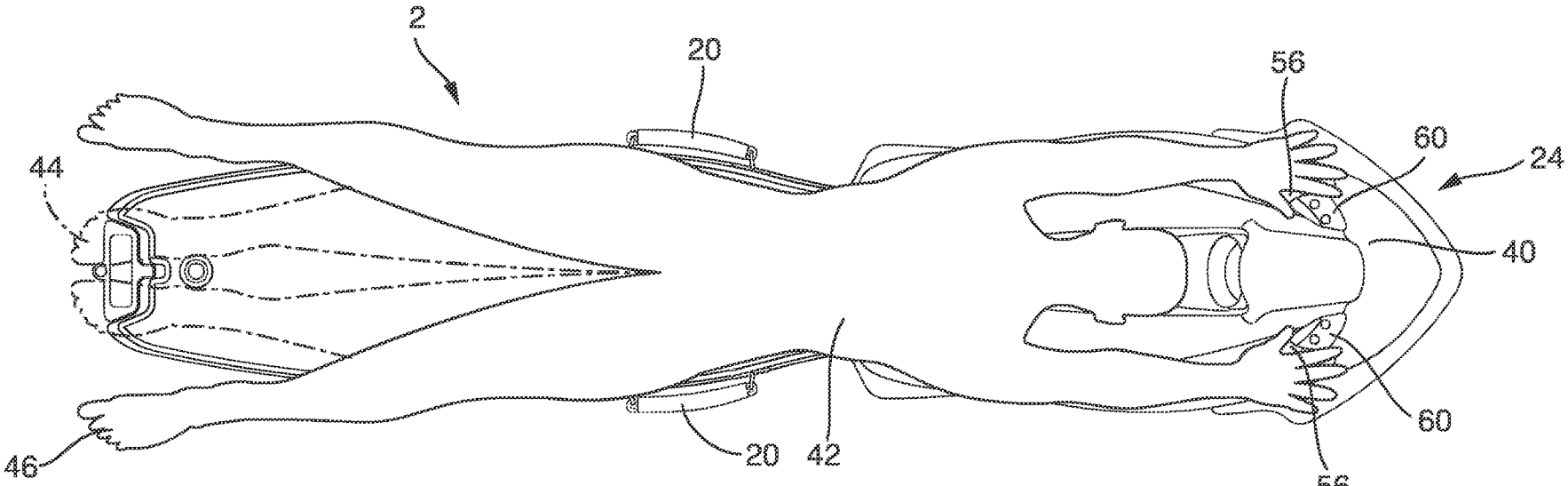
FIG. 9 shows a top view of the aquatic sports device of FIG. 6 with the user lying thereon.
Figure 9A:
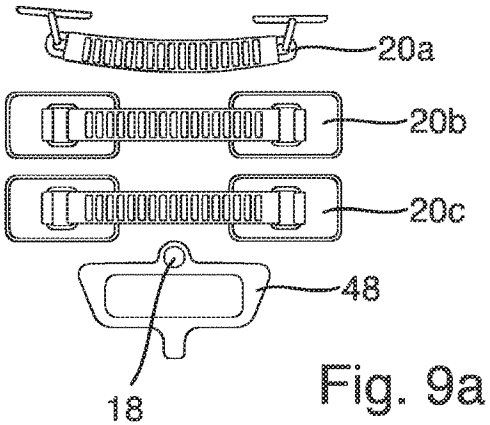
Figure 10:
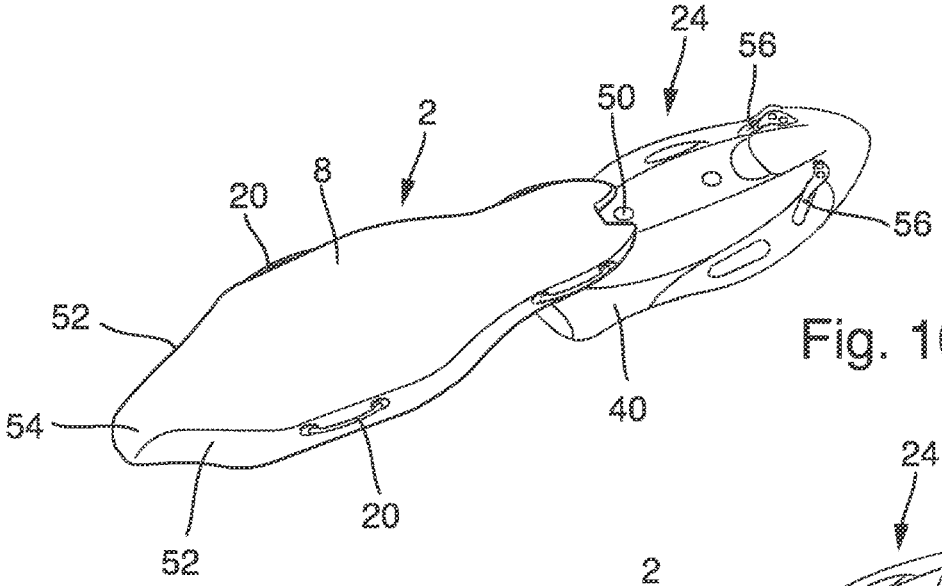
Figure 11:
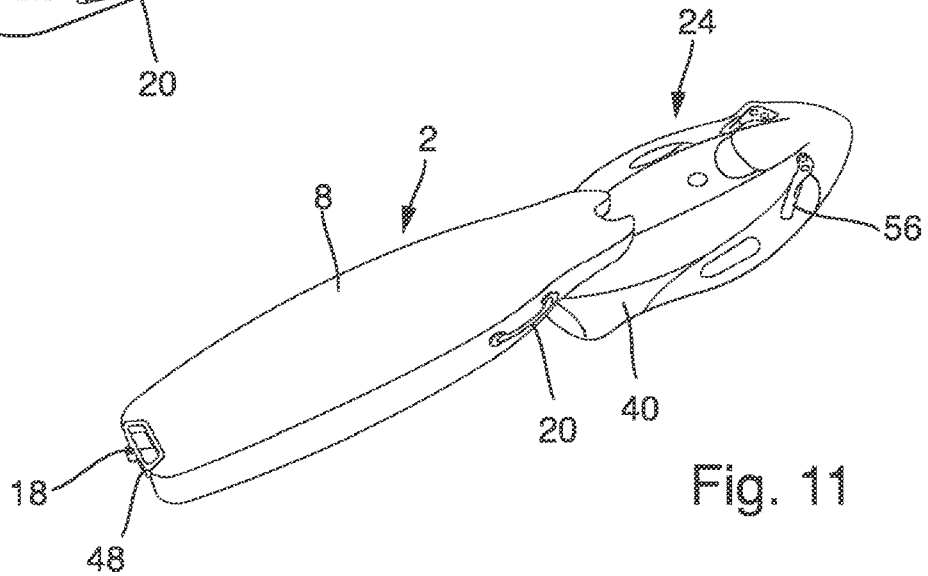
Figure 12:
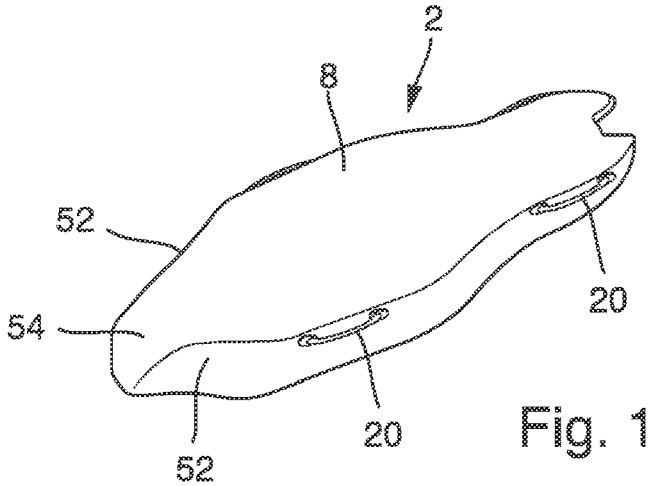
Figure 13:
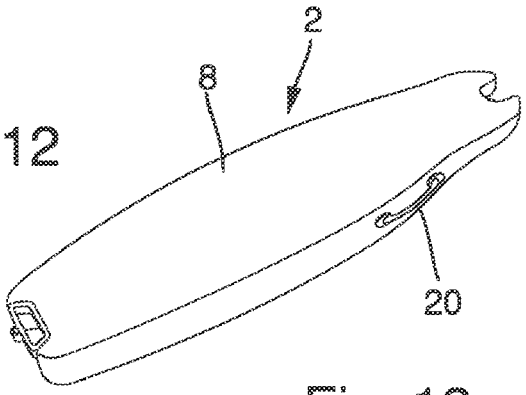
Figure 14:
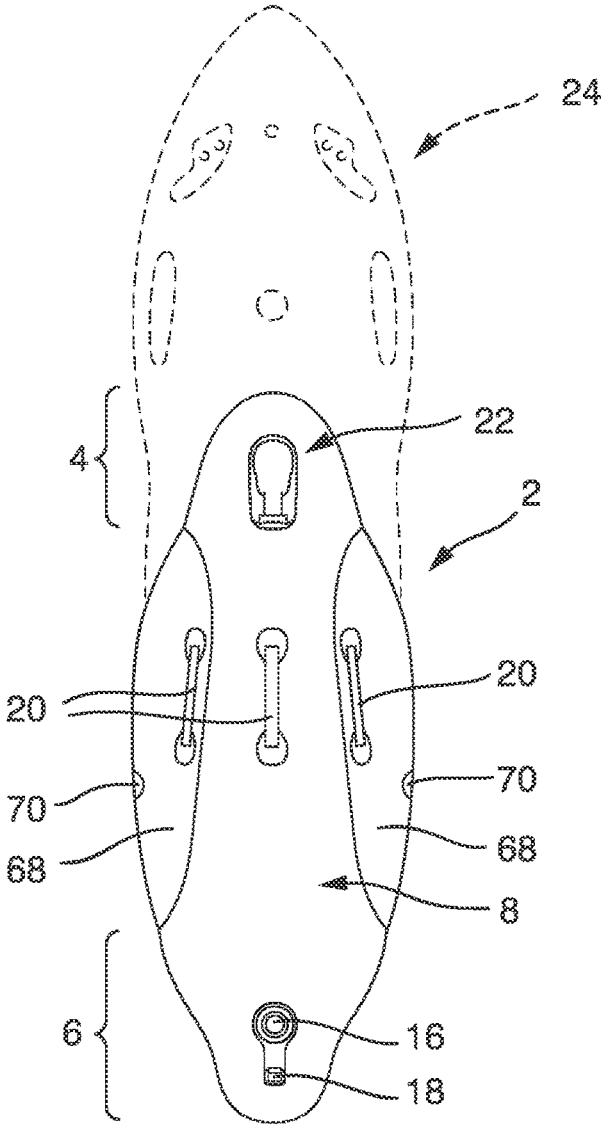
Figure 14A:
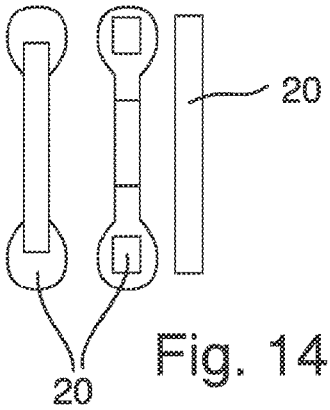
Figure 16:
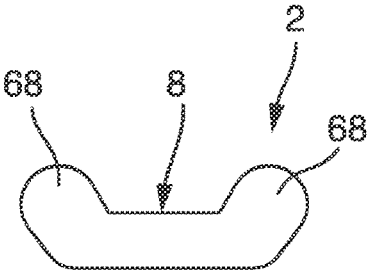
Figure 15:
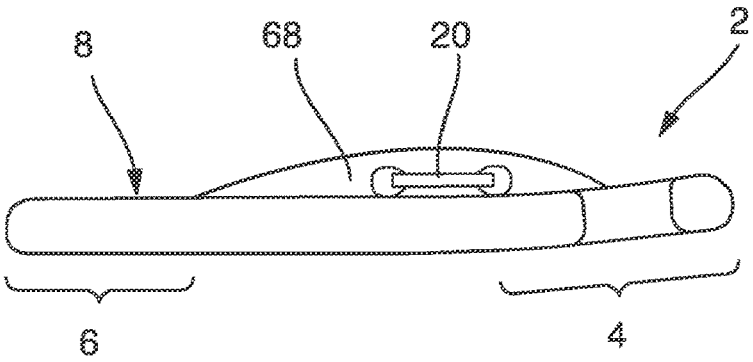
Figure 17:
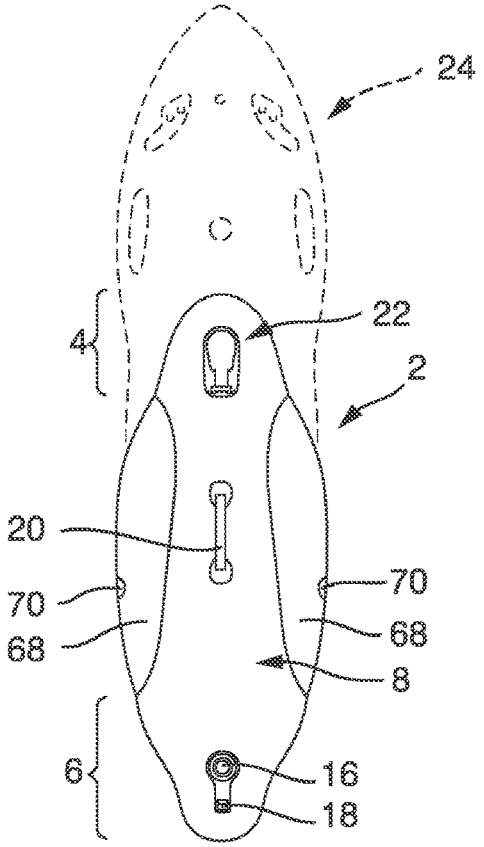
Figure 18:
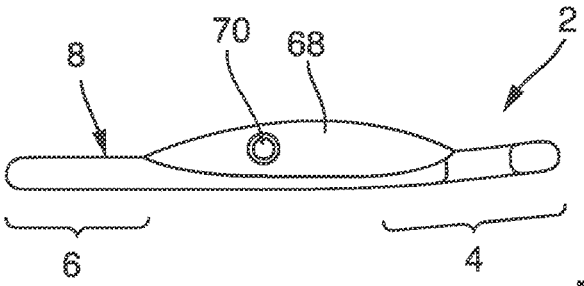
Figure 19:
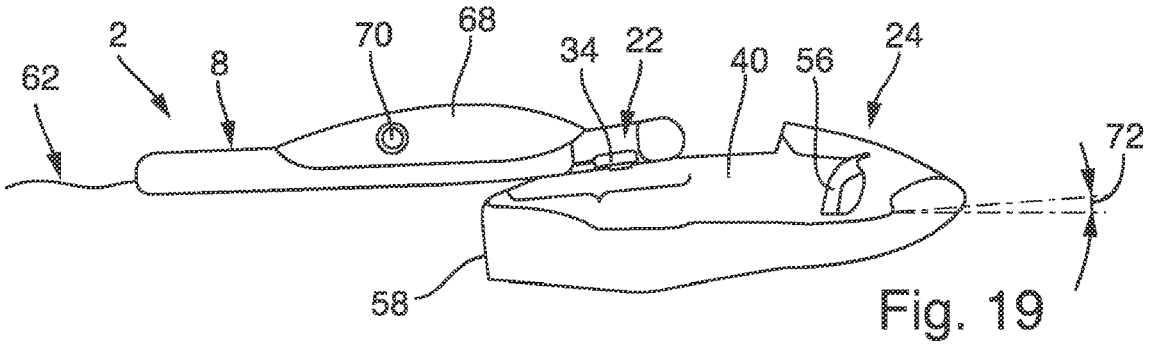

FIG. 9*a* shows various embodiments of handles of the water board and a towing handle of the water board having a tow eye;

FIG. 10 shows a perspective view of the aquatic sports device of FIG. 8;

FIG. 11 shows a perspective view of the aquatic sports device of FIG. 6;

FIGS. 12 and 13 show a perspective view of the water boards of the aquatic sports device of FIGS. 10 and 11;

FIG. 14 shows a plan view of an aquatic sports device according to the invention according to a further preferred embodiment;

FIG. 14*a* shows various embodiments of handles of the water board;

FIG. 15 shows a longitudinal section of a water board of the aquatic sports device of FIG. 14;

FIG. 16 shows a cross-section of the aquatic sports device of FIG. 15;

FIG. 17 shows a plan view of an aquatic sports device according to the invention according to a further preferred embodiment;

FIG. 18 shows a side view of a water board of the aquatic sports device of FIG. 17;

FIG. 19 shows a side view of the aquatic sports device of FIG. 17; and

Figure 20:
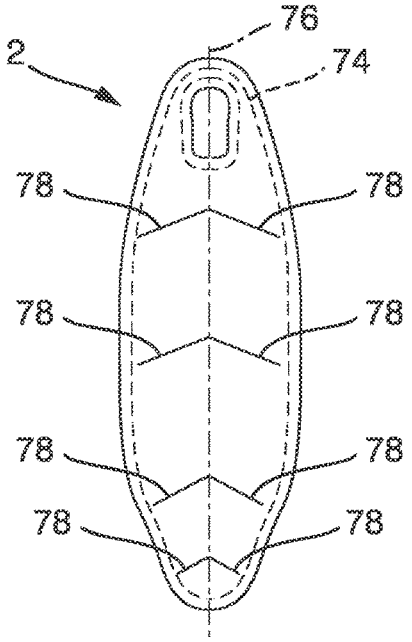

FIG. 20 shows a bottom view of the aquatic sports device of FIG. 18.

Figure 1:
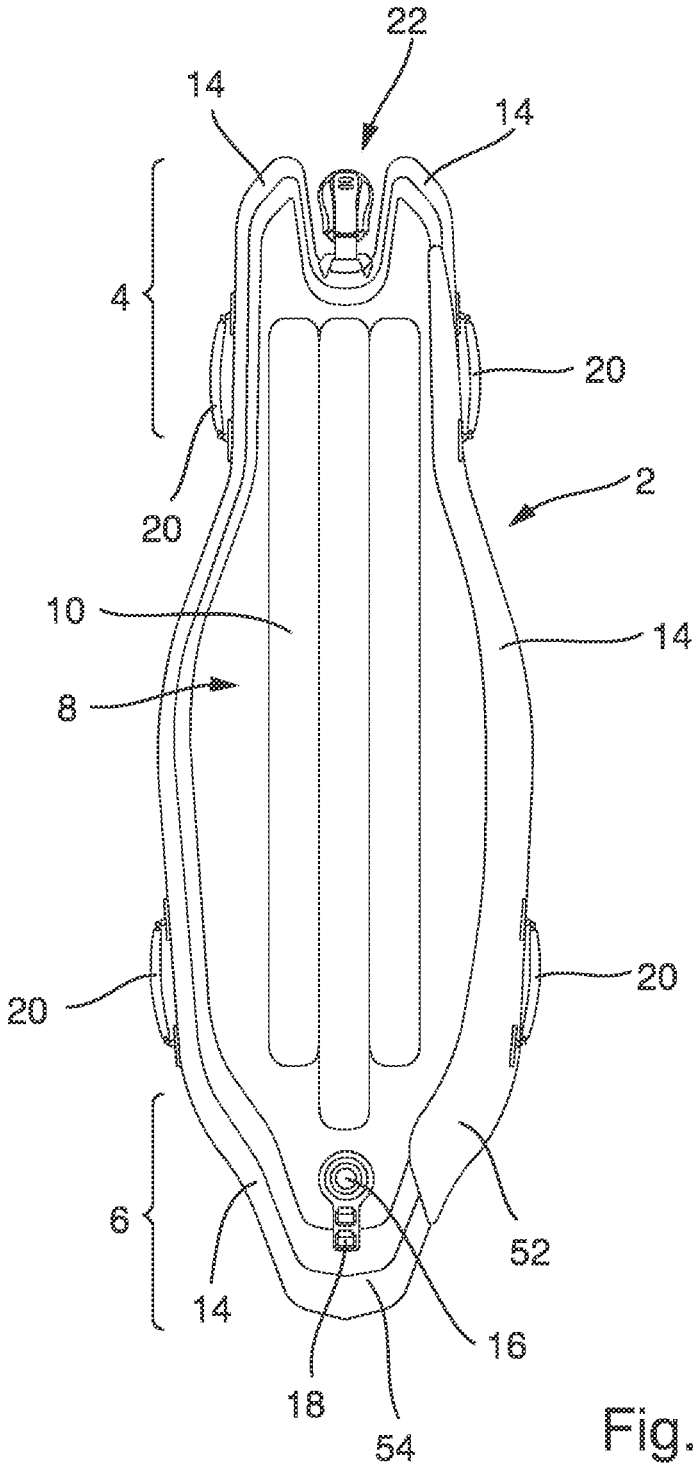

FIG. 1 shows a top view of a water board according to the invention according to various embodiments. Two different embodiments are shown on both sides of a longitudinal axis, which embodiments are explained in more detail below. The water board in its entirety is designated by the reference numeral 2. It is made of a material that can float on water and comprises a front-end area 4 and a rear-end area 6. On a top of the water board 2 there is a support area 8, on which at least part of the user's body rests during normal operation of the water board 2 (cf. FIG. 9). In the exemplary embodiment shown, the support area 8 comprises several, in particular three, longitudinal ribs 10 having a support surface that is convex in cross-section (cf. FIG. 4). The longitudinal ribs 10 extend in parallel to each other in the longitudinal direction along at least part of the top face of the water board 2. In a third version, the support area 8 of the water board 2 can be designed without the longitudinal ribs 10. The water board 2 may be described as including a water board body including the support area 8, the front-end area 4 and the rear-end area 6.

The water board 2 can, for instance, be made of an expanded plastic (e.g. expanded or extruded polystyrene) covered by an outer skin of a water-repellent, robust plastic (e.g. polyethylene, acrylonitrile-styrene-acrylic ester, epoxy resin) or a laminate (e.g. a fiber-plastic composite such as GRP). Particularly preferably the water board 2 comprises an inflatable material, e.g. a drop stitch fabric material. In particular, it is proposed that the water board 2 has a core 12 made of the drop stitch material (cf. FIGS. 3 and 4). The outer shape of the water board 2 is then formed by free-form flanks 14, which are secured to the core 12 on the outside. The free-form flanks 14 are preferably made of a water-repellent, robust plastic material and are secured to the core 12, for instance by gluing or clipping. Of course, it would also be conceivable to make the entire water board 2 from the drop stitch fabric material without using additional free-form flanks 14. However, by using differently shaped free-form flanks 14, different external shapes and embodiments of the water board 2 can be implemented with little effort and at low cost, based on a given uniform basic shape of the core 12.

The core 12 made of drop stitch material can be inflated via a valve 16 provided in the outer skin of the water board 2. In the example shown, the valve 16 is located in a rear-end area 6 on top of the water board 2. Furthermore, in the embodiment shown, a tow eye 18 is provided behind the valve 16, which can be used to tow other water sports enthusiasts with or without a floating device (e.g. another water board, an air mattress, a boat) behind the aquatic sports device of the invention (cf. FIG. 2). Handles 20 are arranged laterally on the water board 2 to facilitate transport for the user and to attach the water board 2 to a motor-powered watercraft 24 (cf. FIG. 2). FIG. 9*a* shows three different embodiments of the handles 20*a*, 20*b*, 20*c*. To improve the feel and water resistance of the handles 20, they are preferably made of neoprene. They are articulated to the water board 2 via metal or plastic eyelets.

Figure 1A:
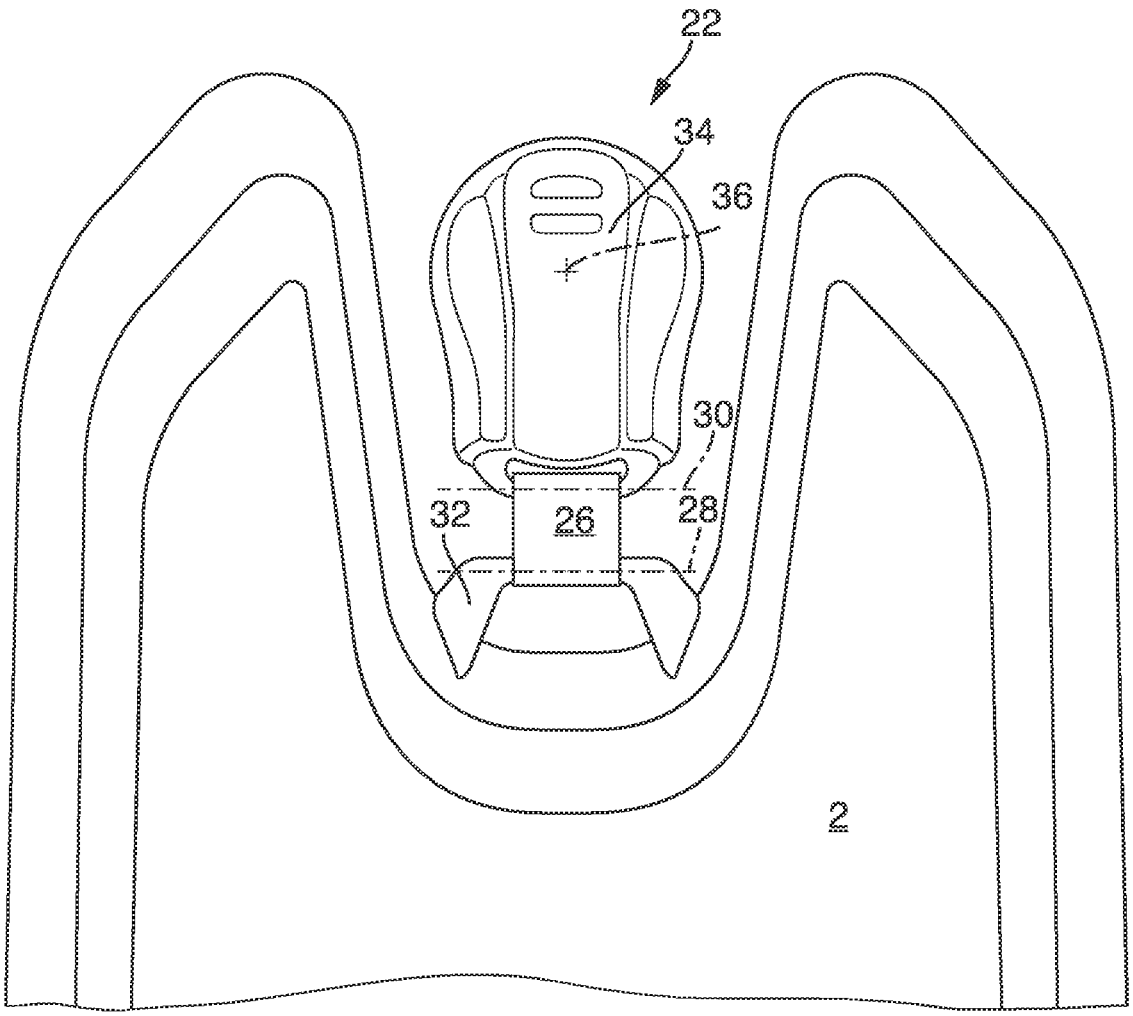
Figure 2:
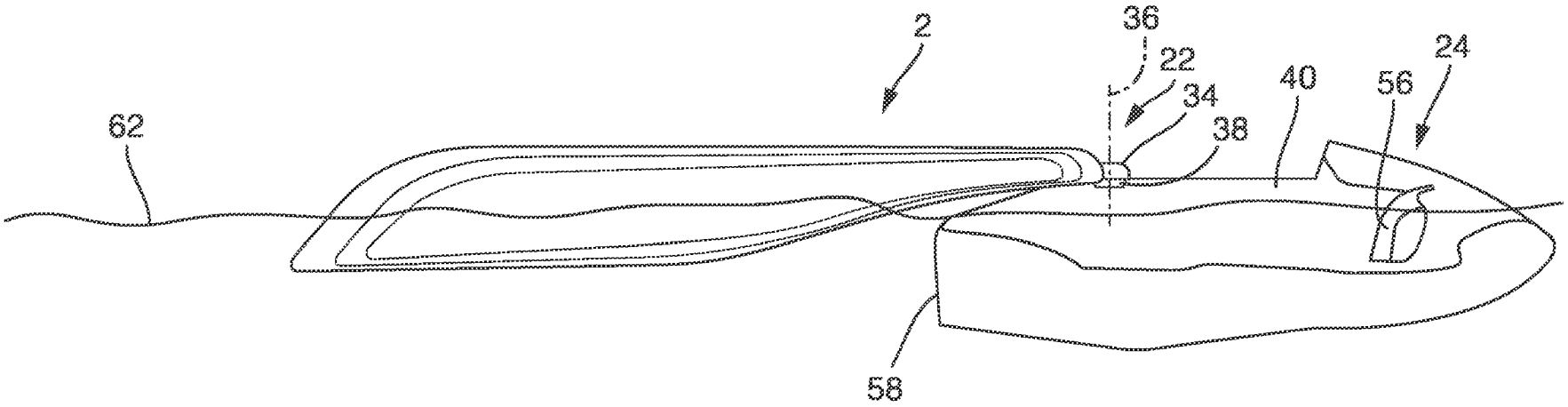
FIG. 2 shows the water board of FIG. 1 in a sectional view and with articulated attachment to a motor-powered watercraft.

In the front-end area 4 the water board 2 has an attachment segment 22 for the articulated attachment of the water board 2 to a watercraft 24 (cf. FIG. 2). The water board 2 and the watercraft 24 in conjunction form the aquatic sports device according to the invention. The attachment segment 22 is shown in detail in FIG. 1*a*. The attachment segment 22 is designed in particular for the detachable attachment of the water board 2 to the watercraft 24, such that the water board 2 can be quickly and easily separated from or secured to the watercraft 24 for ease of transport and storage. A suitable securing element may be provided to prevent an accidental detachment of the attachment between the water board 2 and the watercraft 24.

The attachment segment 22 comprises an articulation 26, which has two parallel axes of rotation 28, 30, wherein a first axis of rotation 28 is articulated to the water board 2 and the other axis of rotation 30 is assigned to the watercraft 24. In particular, the articulation 26 is articulated to a rigid attachment mount 32, which is secured to the front-end area 4 of the water board 2. The articulation 26 can be made of a flexible material (e.g. a textile fabric) or rigid material (e.g. metal or plastic). The axes of rotation 28, 30 extend mainly horizontally when the water board 2 is secured to the watercraft 24. The attachment segment 22 is designed to articulate the water board 2 to the watercraft 24 using at least two articulated axles perpendicular to each other. In the example shown, an attachment element 34 is provided, which can be rotatably attached to the watercraft 24 by a mainly vertical first articulated axle 36. One of the axes of rotation 28, 30 forms another articulated axle. The axes of rotation 28, 30 are perpendicular to the first articulated axle 36.

the attachment element 34 forms a front support segment of the water board 2. The support segment 34 is part of the attachment segment 22 and is designed to rest on the top of the watercraft 24 when the water board 2 is secured to the watercraft 24. The attachment element 34 comprises a downwardly protruding projection 38 having a circular cross-section (cf. FIGS. 2, 3 and 5) or a pin, which can engage with a matching attachment mount 50 (cf. FIG. 10) formed on the upper surface of a hull 40 of the watercraft 24 and can be held therein rotatably about the articulated axle 36. The attachment mount 50 can, for instance, be designed as a recess, into which the projection 38 of the attachment segment 34 is inserted from above. In addition, a safety device may be provided to secure the attachment segment 34 in the attachment mount 50 and to prevent an inadvertent separation of the water board 2 and the watercraft 24. The attachment mount 50 on the top of the hull 40 may also be designed to receive and hold the attachment element of a restraint system (e.g. a safety belt) to secure the user when the water board 2 is not secured to the watercraft 24. Such a restraint system is known from DE 10 2007 032 392 A1.

The support area 8 of the water board 2 is designed such that at least the user's 42 chest and possibly also the user's stomach rest(s) on the water board 2 when the water board 2 is properly attached to the watercraft 24 and when the watercraft 2, 24 is operating as intended. This is shown in FIG. 9 by way of example. The legs and feet of user 42 can also rest on the support area 8 (position 44 of the legs of the user 42 in FIG. 9). Alternatively, it is conceivable that the user 42 spreads the legs such that only the user's thighs rest on the support area 8 and the user's feet and possibly also at least part of the lower legs of user 42 protrude into the water (position 46 of the legs of the user 42 in FIG. 9). A corresponding water board 2, which permits such use, is shown in FIGS. 6, 7, 11 and 13, for instance.

A dragging handle 48 and/or a tow eye 18 may be arranged at the rear-end area 6 of the water board 2 of the FIGS. 6, 11 and 13, which handle and/or tow eye can be used to tow other water sports enthusiasts with or without floating device (e.g. another water board, an air mattress, a boat) behind the aquatic sports device 2, 24 according to the invention. The towing handle 48 with tow eye 18 is shown as a single part at the bottom of FIG. 9*a*. For the sake of clarity, FIGS. 10 to 13 do not show the attachment segment 34. In contrast, FIG. 10 shows the attachment mount 50 to accommodate the attachment segment 34 on the top of the hull 40 of the watercraft 24.

According to another exemplary embodiment of the water board 2 according to the invention, as shown in FIGS. 1, 8, 10 and 12, the support area 8 at the rear-end area 6 of the water board 2 merges into two lateral thigh supports 52 sloping towards the water, on which the upper and/or lower legs of the user rest and between which a clamping area 54 is formed, which is located between the user's upper and lower legs. The user can clamp the clamping area 54 between the user's legs during the intended operation of the aquatic sports device 2, 24 and thereby achieve additional stability. In addition, the feet and possibly also part of the legs, e.g. the lower legs, can protrude into the water and be used to assist in controlling the aquatic sports device 2, 24.

Figure 4:
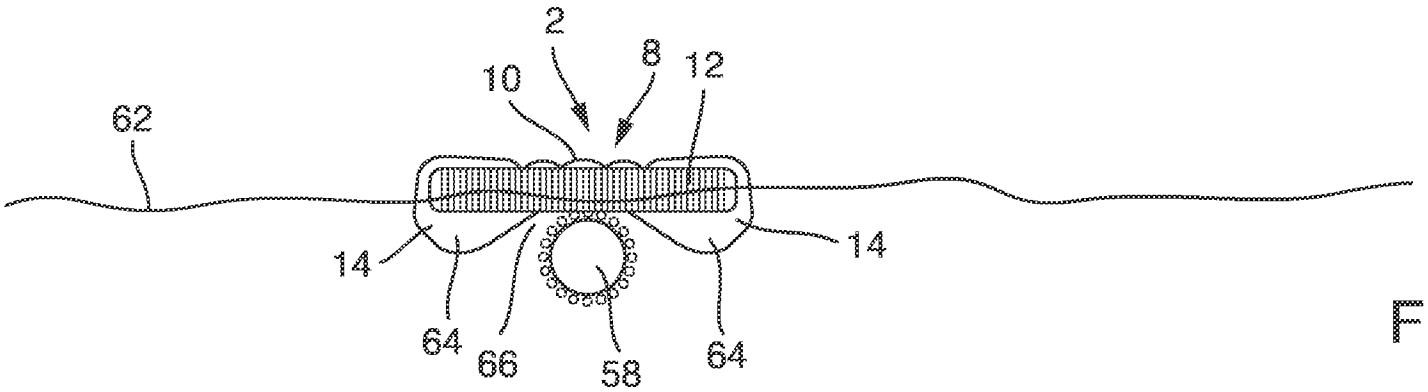
FIG. 4 shows a sectional view of the water board of FIG. 3 viewed from the rear in the direction of travel.
Figure 5:
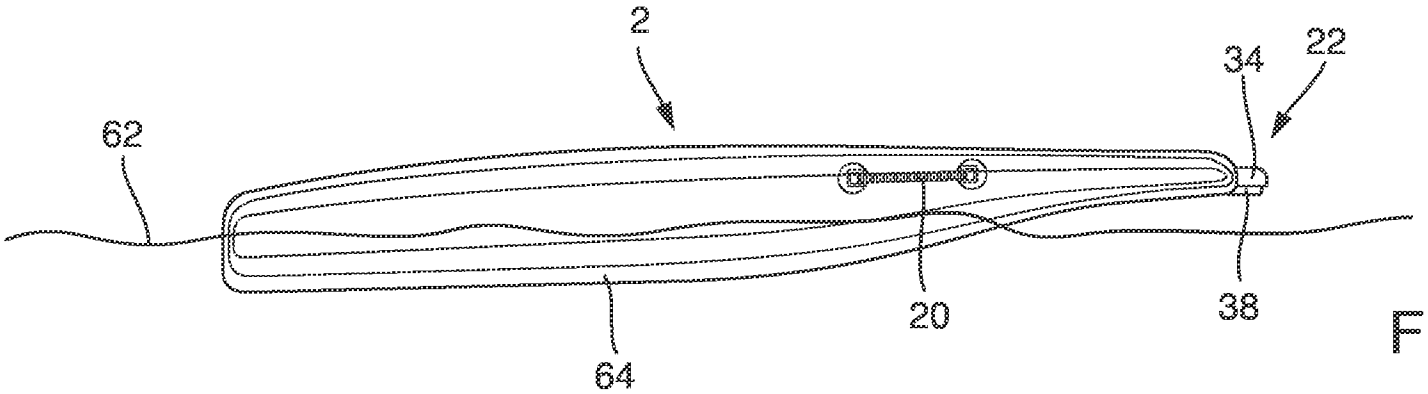
FIG. 5 shows a side view of 3 different embodiments of a water board according to the invention.

The motor-powered watercraft 24 is known per se, for instance from DE 195 11 850 A1 or DE 100 09 278 A1. It has two handles 56 in the front part of the watercraft 24, the user 42 can hold on to (cf. FIG. 9). The watercraft 24 is preferably propelled by a water jet propulsion system, through which a water current is generated through a flow channel on the underside of the watercraft 24, which runs counter to the direction of travel of the watercraft 24. In particular, water is sucked in through an inlet opening in the underside of the hull of the watercraft 24, accelerated by means of a marine propeller located in the flow channel and discharged via an outlet opening 58 (cf. FIGS. 2 and 4) in the area of the stern of the watercraft 24. The marine propeller is preferably driven by an electric motor powered by batteries. The user 42 can steer the watercraft 24 by shifting his/her weight. The user 42 can control the speed of the watercraft 24 by means of controls 60 in the area of the handles 56, for instance by varying the speed of the propeller or an angle of attack of a flap located in the flow channel. In the case of the aquatic sports device 2, 24 according to the invention, the watercraft 24 is mainly used floating on water. A water line is shown in FIGS. 2, 4 and 5 designated by the numeral 62.

Figure 3:
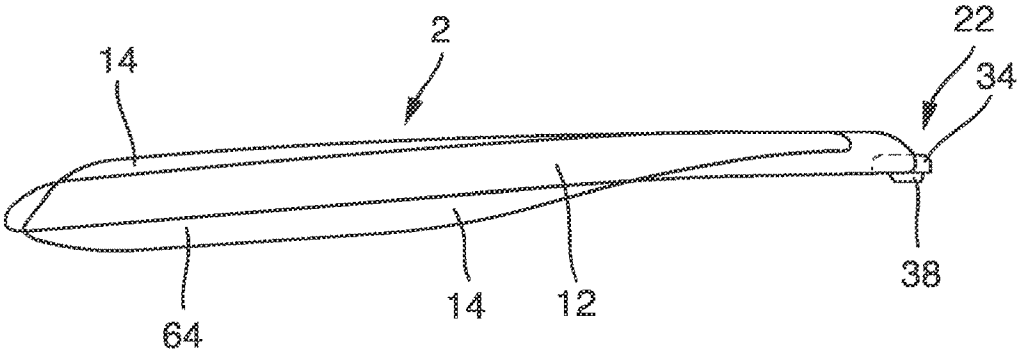
FIG. 3 shows a side view of a preferred embodiment of a water board according to the invention.

FIG. 2 shows outlines of three different sizes or volumes of the water board 2 by way of example. Depending on the weight of the user 42 and the desired buoyancy, a water board 2 having a larger or smaller volume can be selected. FIG. 3 shows a different version of the water board 2 according to the invention. There, the core 12 of inflatable material, for instance a drop stitch fabric material, can be seen inside the water board 2, to which free-form flanks 14 are attached from the outside, at least in some areas. A cross-section of the water board 2 of FIG. 3 is shown in FIG. 4 in a rear view. It is clearly visible that the bottom of the water board 2, which rests on the water, has two laterally arranged skids 64. The skids 64 extend along at least along a part of a longitudinal extension of the water board 2. The skids 64 are preferably formed at the rear-end area 6 of the underside of the water board 2. In particular, the water board 2 has a U-shaped cross-section in the area of the skids 64 (cf. FIG. 4), with distal ends of the two legs of the U-shaped cross-section projecting into the water or resting on the water surface 62 and forming a part of the skids 64. It is preferred that the skids 64 are formed by correspondingly shaped free-form flanks 14.

Because of the lateral arrangement of the skids 64, a recess 66 is formed between the skids 64, through which the water jet accelerated in the flow channel can flow without obstacle, wherein it is guided between the skids 64 along the underside of the water board 2. This provides improved dynamic stability of the aquatic sports device 2, 24 when it is driven straight ahead. The water jet, after flowing out of the outlet 58 of the flow channel, does not collide with the water board 2 secured to the watercraft 24, which makes for a particularly efficient propulsion of the watercraft 2, 24. In addition, a suction effect, which is caused by the jet of water flowing underneath the water board 2 and which can pull the water board 2 downwards, is reduced by the skids 64, as there is a particularly large distance between the underside of the water board 2 in the area of the recess 66 and of the water jet.

FIGS. 14-16 show a further exemplary embodiment of this invention. FIG. 14 shows a plan view of an aquatic sports device 2, 24, which comprises a motorized watercraft 24 and a water board 2 in a further embodiment. The water board 2 differs from the previously described water board 2 by various features. The support area 8, for instance, is at least partially laterally delimited by support flanks 68, which support a user 42 laterally and thus makes it more difficult for the user 42 to accidentally slide down from the support area 8, and ideally even prevents it. Because of the support flanks 68, in top view the support area 8 has approximately the shape of an hourglass, namely it has a larger width in the end areas 4, 6 than in the middle, where the support area 8 is cinched-in. The support flanks 68 are preferably designed as inflatable air chambers separate from the rest of the water board 2. Each of the air chambers, for instance, has a volume of 10-15 liters, in particular 11-12 liters. Valves 70, which are preferably formed on the outer walls of the support flanks 68, can be used to inflate the support flanks 68 and to deflate the support flanks 68.

In this embodiment as well, the water board 2 preferably comprises an inflatable material, e.g. a drop stitch fabric material. The inflatable support flanks 68 are secured to the side thereof, for instance by sewing and/or vulcanizing. In this way, the entire water board 2 including the support flanks 68 can be deflated and the water board 2 can be folded in very compact dimensions. FIG. 16 clearly shows how the lateral support flanks 68 delimit the support area 8 laterally and in conjunction therewith form a recess for safely holding the user 42. Approximately in the center, the water board 2 has handles 20, one of which is located on the support area 8 in the area of a longitudinal axis of the water board 2, and two of which are located on the sides of inwardly directed walls of the support flanks 68. FIG. 14*a* shows three different types of handles 20 by way of example.

The longitudinal section of FIG. 15 through the water board 2 according to the invention, is used to illustrate a further difference of this exemplary embodiment compared to the exemplary embodiments described so far. This concerns the front-end area 4 of water board 2, which is inclined upwards by a few degrees. Preferably, the front-end segment 4 is inclined upwards by about 3°-8°, particularly preferably by 5°. During the operation of the watercraft 24, the bow of the watercraft rises out of the water by an angle of attack 72 of about 3° to 10°, in particular 5°. The angled front-end segment 4 of the water board 2 is adapted to the angle of attack 72 of the watercraft 24 during operation, thus preventing the inclined watercraft 24 from transferring large bending moments to the front-end area 4 of the water board 2.

FIGS. 17-20 show a further exemplary embodiment of the present invention. In contrast to the exemplary embodiment of FIGS. 14-16, for instance, on the support area 8 only one handle 20 is arranged on the longitudinal axis of the water board 2. No further handles 20 are provided on the support flanks 68. FIG. 18 shows a side view of the water board 2 of the aquatic sports device 2, 24 of FIG. 17. FIG. 19 shows a side view of the aquatic sports device 2, 24, wherein the area of the attachment segment 22 with the attachment element 34 is shown in cross-section. It is clearly visible how the angled front-end area 4 of the water board 2 is adapted to the angle of attack 72 of the watercraft 24.

FIG. 20 shows a view from below of the water board 2. A contact surface of the bottom of the water board 2 with the water surface 72 is designated by the numeral 74. An outer contour of the drop stitch inflatable fabric material is designated by the numeral 76. The underside of the water board 2 has a mainly flat surface, except for any slight curvature in the longitudinal and/or transverse axis. Several trailing edges 78 are arranged on the underside of the water board 2. The trailing edges 78 protrude downwards beyond a surface extension of the underside and protrude into the water. The trailing edges 78 each have a direction of extension with a component directed transversely to a longitudinal extension of the water board 2 and thus also to a direction of travel of the aquatic sports device 2, 24. The trailing edges 78 reduce a suction effect, which is caused by the water jet flowing beneath the water board 2 and which can pull the water board 2 downwards. This is accomplished by sucking in air from the side via the trailing edges 78 and directing it beneath the water board 2 into the area of the water jet. There the air causes a stall, reducing the suction effect. Several trailing edges can be arranged one behind the other in the longitudinal direction of the water board 2 and spaced apart from each other. The rearmost trailing edges 78 are located about 5 cm away from the rear end of the water board 2. Two oblique trailing edges 78 can be combined to form a V-shape, with one tip of the V pointing forward and lying approximately on a longitudinal central axis of the water board 2.

The invention claimed is:

1. A water board and watercraft in combination, comprising:

a motor-driven watercraft having a vehicle hull configured such that at least part of a body of an operator of the watercraft may rest on the vehicle hull;

a water board body made of a material that can float on water, the water board body including:

a support area configured such that the operator's body may at least partially rest on the support area;

a front-end area; and two lateral skids on an underside of the water board body, the two lateral skids extending along at least a part of a length of the water board body; and an attachment segment located on the front-end area and configured for articulated connection of the water board body to the watercraft, wherein the attachment segment includes a front support segment that rests on an upper surface of the watercraft when the water board is secured to the watercraft.

2. The water board and watercraft in combination of claim 1, wherein:

the attachment segment is configured for the detachable attachment of the water board to the watercraft.

3. The water board of claim 1, wherein:

the support area is configured such that at least the operator's user's chest may rest on the support area.

4. The water board of claim 3, wherein:

the support area is configured such that the operator's stomach may also rest on the support area.

5. The water board of claim 3, wherein:

the water board body also includes a rear-end area including two lateral thigh supports configured to slope towards the water when the water board is floating on the water;

the support area merges into the two lateral thigh supports such that the thighs of the operator may rest on the thigh supports; and the rear-end area includes a clamping area formed between the two lateral thigh supports, which clamping area may be received between the operator's thighs.

6. The water board and watercraft in combination of claim 3, wherein:

the support area includes support flanks configured to laterally support the operator.

7. The water board and watercraft in combination of claim 1, wherein:

the attachment segment includes an articulation including first and second parallel axes of rotation, the articulation being articulated to the water board body about the first axis of rotation, and the second axis of rotation being configured such that the articulation may be articulated relative to the watercraft about the second axis of rotation.

8. The water board and watercraft in combination of claim 7, wherein:

the first and second axes of rotation extend mainly horizontally when the water board is secured to the watercraft.

9. The water board and watercraft in combination of claim 8, wherein:

the attachment segment is further configured to articulate the water board relative to the watercraft about a third axis of rotation extending mainly vertically when the water board is secured to the watercraft.

10. The water board and watercraft in combination of claim 1, wherein:

the attachment segment is configured to articulate the water board relative to the watercraft about two perpendicular axes of articulation.

11. The water board and watercraft in combination of claim 10, wherein:

one of the two perpendicular axes of articulation extends mainly vertically when the water board is secured to the watercraft.

12. The water board and watercraft in combination of claim 1, wherein:

the front-end area is angled upwards in a range of from about 3° to about 8° with respect to the support area.

13. The water board and watercraft in combination of claim 1, wherein:

the water board body includes a bottom surface configured to rest on the water when the water board is floating on the water; and the water board body includes trailing edges projecting downwards beyond the bottom surface and into the water, each of the trailing edges having an extension direction having a component transverse to a longitudinal axis of the water board body.

14. The water board and watercraft in combination of claim 1, wherein:

the material from which the water board body is made is at least partially an inflatable material.

15. The water board and watercraft in combination of claim 14, wherein:

the inflatable material is a drop stitch material.

16. The water board and watercraft in combination of claim 1, wherein:

the underside of the water board body is a flat underside configured to rest on the water.

* * * * *